US010444657B2

(12) United States Patent
Yada et al.

(10) Patent No.: US 10,444,657 B2
(45) Date of Patent: Oct. 15, 2019

(54) CHARGE VOLTAGE CONTROLLER FOR PROCESS UNIT OF IMAGE FORMING APPARATUS, METHOD OF CONTROLLING THE SAME, AND NON-TRANSITORY COMPUTER-READABLE STORAGE MEDIUM

(71) Applicant: Brother Kogyo Kabushiki Kaisha, Hagoya-shi, Aichi-ken (JP)

(72) Inventors: Kengo Yada, Seki (JP); Hiroshige Hiramatsu, Inuyama (JP); Shota Iriyama, Toyokawa (JP); Chieko Mimura, Nagoya (JP); Hotaka Kakutani, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/137,674

(22) Filed: Sep. 21, 2018

(65) Prior Publication Data

US 2019/0163085 A1 May 30, 2019

(30) Foreign Application Priority Data

Nov. 30, 2017 (JP) ..... 2017-230450

(51) Int. Cl.
*G03G 15/02* (2006.01)

(52) U.S. Cl.
CPC ..... *G03G 15/0266* (2013.01)

(58) Field of Classification Search
CPC ..... G03G 15/0266
USPC ..... 399/50
See application file for complete search history.

(56) References Cited

U.S. PATENT DOCUMENTS 4,890,125 A * 12/1989 Egawa ..... G03G 15/0266 347/137
9,002,224 B2 * 4/2015 Motomura ..... G03G 15/1645 399/50
2004/0190921 A1 * 9/2004 Bae ..... G03G 15/0266 399/50
2010/0061747 A1 * 3/2010 Choi ..... G03G 15/0266 399/50
2014/0219671 A1 8/2014 Matsuura
2015/0277272 A1 * 10/2015 Aoki ..... G03G 15/065 399/44

(Continued)

FOREIGN PATENT DOCUMENTS

JP 2006276471 A * 10/2006
JP 2009151068 A 7/2009

(Continued)

*Primary Examiner* — Robert B Beatty
(74) *Attorney, Agent, or Firm* — Banner & Witcoff, Ltd.

(57) ABSTRACT

Apparatus, methods, and computer-readable mediums are described for adjusting a charge voltage for a photosensitive member to account for accumulated charge quantity. In one example, currents related to charging a charger, which imparts a charge to a photosensitive member, are monitored. Based on the monitored currents, a new charging voltage may be determined and applied that accounts for accumulated charge quantity in the photosensitive member. A transfer current related to a transfer charge may also be monitored or a predetermined value used. The determination of the new charging voltage may be performed at various times.

18 Claims, 7 Drawing Sheets

(56) References Cited

U.S. PATENT DOCUMENTS

2016/0077456 A1* 3/2016 Kojima ..... G03G 15/0266
399/50

FOREIGN PATENT DOCUMENTS

| | | | | |
|---|---|---|---|---|
| JP | 2014153410 | A | | 8/2014 |
| JP | 2016018179 | A | * | 2/2016 |
| JP | 2016164586 | A | | 9/2016 |
| JP | 2016164587 | A | | 9/2016 |

* cited by examiner

CHARGE VOLTAGE CONTROLLER FOR PROCESS UNIT OF IMAGE FORMING APPARATUS, METHOD OF CONTROLLING THE SAME, AND NON-TRANSITORY COMPUTER-READABLE STORAGE MEDIUM

CROSS-REFERENCE TO RELATED APPLICATION

This application claims priority from Japanese Patent Application No. 2017-230450 filed on Nov. 30, 2017, the content of which is incorporated herein by reference in its entirety.

TECHNICAL FIELD

Aspects disclosed herein relate to an image forming apparatus including a photosensitive member, a method of controlling the image forming apparatus, and a non-transitory computer-readable storage medium storing a program.

BACKGROUND

Some known electrophotographic image forming apparatuses, for example, form a developer image onto a photosensitive layer of a photosensitive member. The photosensitive member contacts a member, and slides relative to the member during rotation. Sliding of the photosensitive member relative to the member causes friction therebetween, thereby causing charge accumulation inside the photosensitive layer of the photosensitive drum. Such charge accumulation may change a relationship between a charge current, which passes through a charger for charging the photosensitive member, and a surface potential of the photosensitive member, thereby failing to control the surface potential of the photosensitive drum to have a desired surface potential.

In order to solve such a problem, some known technique has been used. In the known technique, for example, an accumulated charge quantity in the photosensitive layer is predicted. Based on the prediction, the larger the accumulated charge quantity is present, the greater the absolute value is specified for a charge voltage or the charge current (e.g., the magnitude of the charge voltage or charge current is increased over the magnitude of an initial charge voltage or charge current). More specifically, in the known technique, the accumulated charge quantity is predicted based on, for example, a transfer current, a rotating speed of the photosensitive member, and/or temperature.

SUMMARY

The following summary presents a simplified summary of certain features. The summary is not an extensive overview and is not intended to identify key or critical elements.

Apparatus, methods, and computer-readable mediums are described for adjusting a charge voltage for a photosensitive member to account for accumulated charge quantity. In one example, currents related to charging a charger, which imparts a charge to a photosensitive member, are monitored. Based on the monitored currents, a new charging voltage may be determined and applied that accounts for accumulated charge quantity in the photosensitive member. A transfer current related to a transfer charge may also be monitored or a predetermined value used. The determination of the new charging voltage may be performed at various times.

These and other features and advantages are described in greater detail below.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

First Illustrative Embodiment

Figure 1:
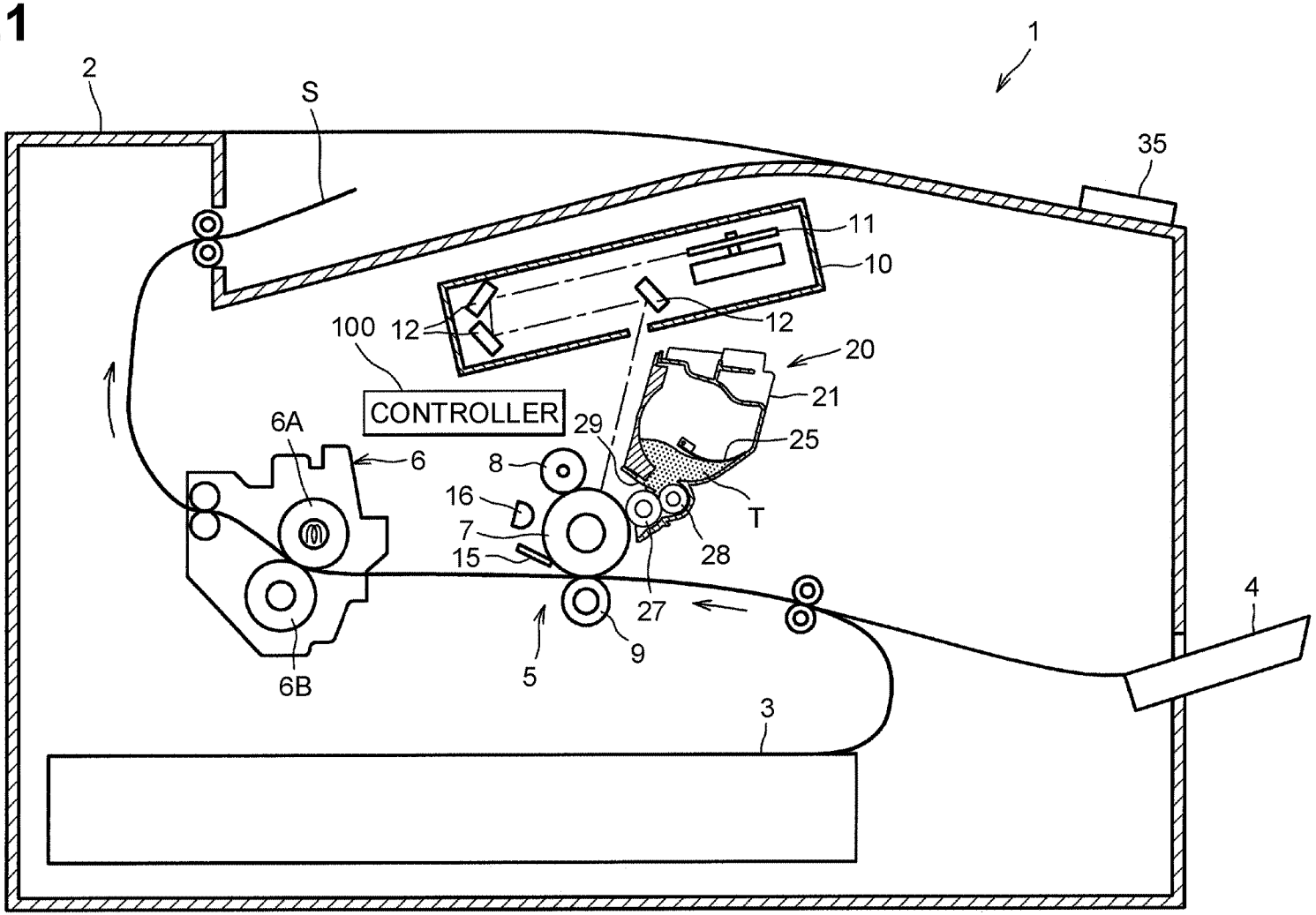
FIG. 1 is a sectional view illustrating an image forming apparatus in a first illustrative embodiment according to one or more aspects of the disclosure.

Hereinafter, an image forming apparatus according to a first illustrative embodiment will be described.

The image forming apparatus may be a laser printer 1. The laser printer 1 is configured to form an image onto a sheet S (an example of a transfer medium). The laser printer 1 includes a casing 2, a feed tray 3, a multipurpose tray 4, a process unit 5, a fixing unit 6, and a controller 100. The laser printer 1 further includes a display 35.

The process unit 5 is configured to form a developer image onto a sheet S. The process unit 5 includes a photosensitive drum 7 (an example of a photosensitive member), a charge roller 8 (an example of a charger), a transfer roller 9 (an example of a transfer member), a scanner 10, and a developer cartridge 20.

The scanner 10 is disposed in an upper portion of the casing 2. The scanner 10 includes a laser source (not illustrated), a polygon mirror 11, reflectors 12 and lenses (not illustrated). In the scanner 10, the laser source emits a laser beam. The emitted laser beam travels to a circumferential surface of the photosensitive drum 7 while being reflected off the polygon mirror 11 and the reflectors and passing through the lenses. Thus, the laser beam scans the circumferential surface of the photosensitive drum 7 at a high scanning speed.

The developer cartridge 20 includes a housing 21, an agitator 25, a developing roller 27, a supply roller 28, and a blade 29 for regulating a thickness of a toner layer. The housing 21 is configured to store toner T (an example of developer) therein.

The housing 21 supports the agitator 25, the developing roller 27, and the supply roller 28 rotatably.

The developing roller 27 faces the photosensitive drum 7. The supply roller 28 supplies toner T from a developer chamber of the housing 21 onto a circumferential surface of the developing roller 27. The developing roller 27 further supplies toner T onto the circumferential surface of the photosensitive drum 7.

The photosensitive drum 7 includes a cylindrical base, and a photosensitive layer formed on an outer circumferential surface of the cylindrical base. The cylindrical base may be made of, for example, metal. The photosensitive drum 7 is configured to rotate clockwise in FIG. 1. The photosensitive layer may be positively chargeable. The photosensitive layer may include a single layer. The photosensitive layer may be applied with coating for protection and/or increase of durability.

The charge roller 8 is disposed above the photosensitive drum 7. The charge roller 8 is configured to rotate while being in contact with the circumferential surface, i.e., the photosensitive layer, of the photosensitive drum 7.

The transfer roller 9 faces the photosensitive drum 7. The transfer roller 9 is disposed below the photosensitive drum 7.

The laser printer 1 further includes a cleaning blade 15. The cleaning blade 15 is disposed downstream from the transfer roller 9 in a rotating direction of the photosensitive drum 7. The cleaning blade 15 has one end that is in contact with the circumferential surface, i.e., the photosensitive layer, of the photosensitive drum 7.

The laser printer 1 further includes an LED lamp 16. The LED lamp 16 is disposed downstream from the cleaning blade 15 in the rotating direction of the photosensitive drum 7.

The photosensitive drum 7 may be positively charged by the charge roller 8 during rotation. The scanner 10 then exposes the circumferential surface of the photosensitive drum 7 with a laser beam to form an electrostatic latent image thereon. Thereafter, the developing roller 27 supplies toner T onto the circumferential surface of the photosensitive drum 7 to form a toner image on the circumferential surface of the photosensitive drum 7. While a sheet S passes between the photosensitive drum 7 and the transfer roller 9, the toner image is transferred onto the sheet P from the photosensitive drum 7 by application of a transfer bias to the transfer roller 9.

The fixing unit 6 is disposed downstream from the process unit 5 in a direction in which a sheet S is conveyed. The fixing unit 6 includes a fixing roller 6A and a pressure roller 6B. The pressure roller 6B presses the fixing roller 6A. The fixing roller 6A includes a cylindrical body and a heater in an internal space of the cylindrical body. The fixing unit 6 fixes the toner image onto the sheet S by heat applied by the heater while sandwiching the sheet S between the fixing roller 6A and the pressure roller 6B.

Figure 2:
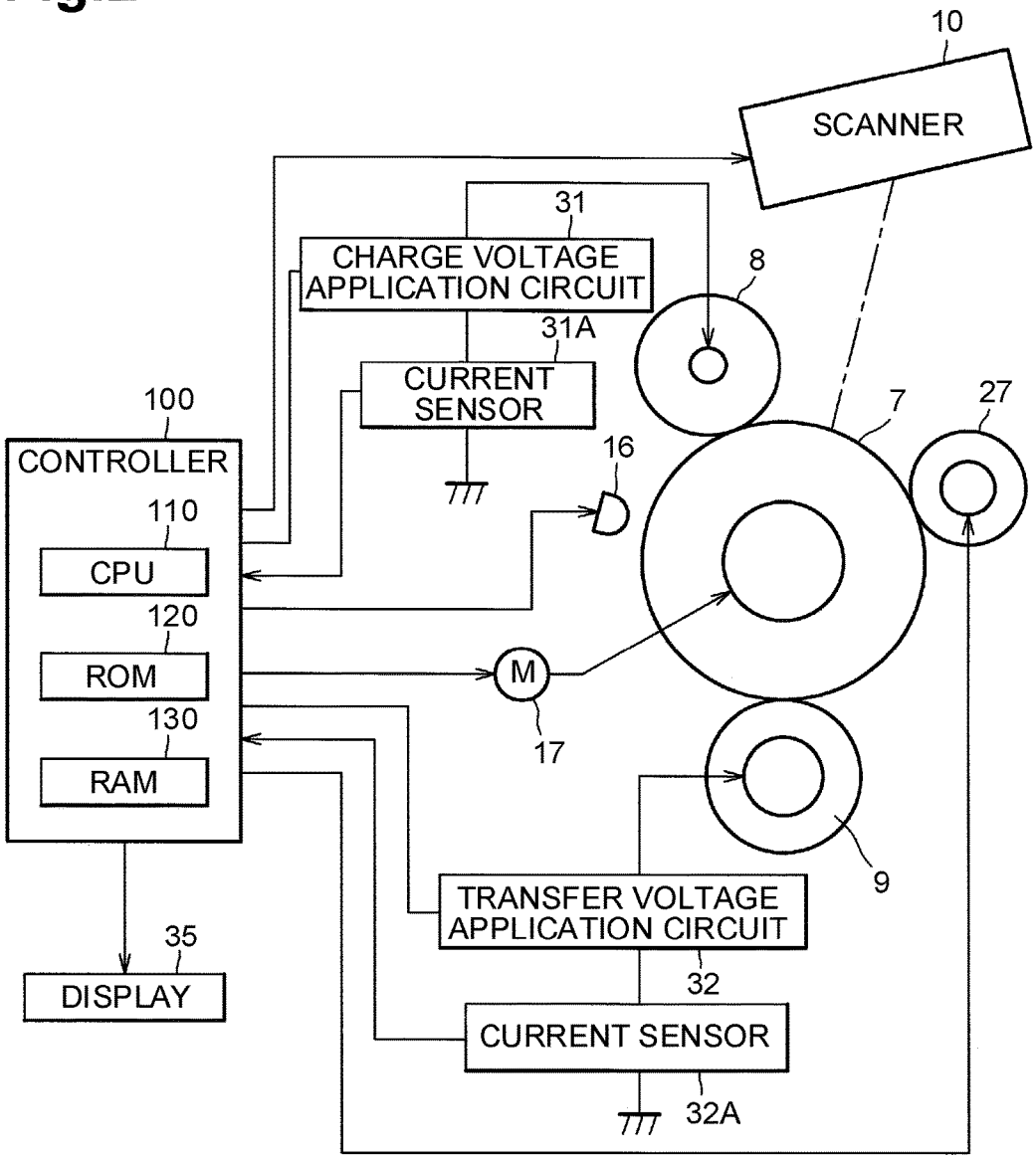
FIG. 2 illustrates an internal configuration of the image forming apparatus in the first illustrative embodiment according to one or more aspects of the disclosure.

As illustrated in FIG. 2, the controller 100 is configured to execute various operation controls such as receipt of print data, sheet feeding from the feed tray 3 or the multipurpose tray 4, operations of various units such as the process unit 5 and the fixing unit 6, in accordance with one or more preinstalled programs. In other words, the one or more programs enable the controller 100 to execute various processing as described below.

More specifically, the controller 100 includes a single or a plurality of electric circuits such as a CPU 110, a ROM 120, and a RAM 130. The ROM 120 stores programs for controlling units and members of the laser printer 1 and various data such as various settings. The RAM 130 is used by the CPU 110 as a work space for executing the programs and as a storage space for storing data temporarily. The CPU 110 executes various calculations based on, for example, instructions outputted by an external device (not illustrated) such as a general-purpose computer, signals outputted by a current sensor 31A (an example of a first sensor) or by a current sensor 32A (an example of a second sensor), the one or more programs and/or data read from the ROM 120.

The controller 100 is configured to control the units and members of the laser printer 1 by outputting control signals to those units and members based on calculation results of the CPU 110. The controller 100 is further configured to output, to the external device (e.g., the computer), signals responsive to an operating status of the laser printer 1.

The controller 100 is configured to control operations of the photosensitive drum 7, the charge roller 8, the transfer roller 9, the developing roller 27, the LED lamp 16, and the scanner 10.

The laser printer 1 further includes a motor 17 and a plurality of gears (not illustrated). The motor 17 is connected to the photosensitive drum 7 via the plurality of gears. The motor 17 is configured to drive the photosensitive drum 7. The controller 100 is configured to control motion of the photosensitive drum 7 by outputting a control signal such as a pulse width modulation ("PWM") signal to the motor 17. More specifically, for example, the controller 100 controls the photosensitive drum 7 to start or stop rotating via the motor 17.

The charge roller 8 is electrically connected to a charge voltage application circuit 31. The charge voltage application circuit 31 is further electrically connected to the controller 100. The charge voltage application circuit 31 is configured to apply a charge voltage to the charge roller 8. The controller 100 is further configured to control the charge voltage application circuit 31 by outputting a control signal such as a PWM signal to the charge voltage application circuit 31. More specifically, for example, the controller 100 controls the charge voltage application circuit 31 to supply electric power to the charge roller 8. The controller 100 specifies a charge voltage to be applied to the charge roller 8 such that the surface potential of the circumferential surface of the photosensitive drum 7 becomes a predetermined potential. The charge voltage application circuit 31 is connected to the current sensor 31A. The current sensor 31A is configured to detect a charge current passing through the charge roller 8. The current sensor 31A is further configured to output, to the controller 100, a detection signal corresponding to a charge current passing through the charge roller 8 when the charge voltage application circuit 31 applies a charge voltage to the charge roller 8.

The transfer roller 9 is electrically connected to a transfer voltage application circuit 32. The transfer voltage application circuit 32 is further electrically connected to the controller 100. The transfer voltage application circuit 32 is configured to apply a transfer voltage to the transfer roller 9. The controller 100 is further configured to control the transfer voltage application circuit 32 by outputting a control signal such as a PWM signal to the transfer voltage application circuit 32. More specifically, for example, the controller 100 controls the transfer voltage application circuit 32 to supply electric power to the transfer roller 9. The controller 100 controls a transfer voltage to be applied to the transfer roller 9 such that a current passing through the transfer roller 9 from the photosensitive drum 7 becomes a predetermined current. More specifically, for example, the controller 100 specifies, as a transfer current, a value corresponding to a difference between a surface potential (e.g., an exposure potential) of the photosensitive drum 7 that has undergone exposure and a developing voltage. In other words, the controller 100 specifies the transfer current as a necessary current for transferring a toner image onto a sheet S from the circumferential surface of the photosensitive drum 7. The transfer voltage application circuit 32 is connected to the current sensor 32A. The current sensor 32A is configured to detect a transfer current passing through the transfer roller 9. The current sensor 32A is further configured to output, to the controller 100, a detection signal corresponding to a transfer current passing through the transfer roller 9 when the transfer voltage application circuit 32 applies a transfer voltage to the transfer roller 9.

The developing roller 27 is electrically connected to a power supply (not illustrated). The developing roller 27 is configured to be applied with a predetermined voltage (e.g., a developing bias) based on a control signal such as a PWM signal outputted by the controller 100 during printing.

The LED lamp 16 (an example of a charge eraser) is configured to irradiate the circumferential surface of the photosensitive drum 7 with light to erase charge from the surface of the photosensitive layer. The LED lamp 16 is connected to the controller 100. The controller 100 controls the LED lamp 16 to turn on and off.

Figure 3:
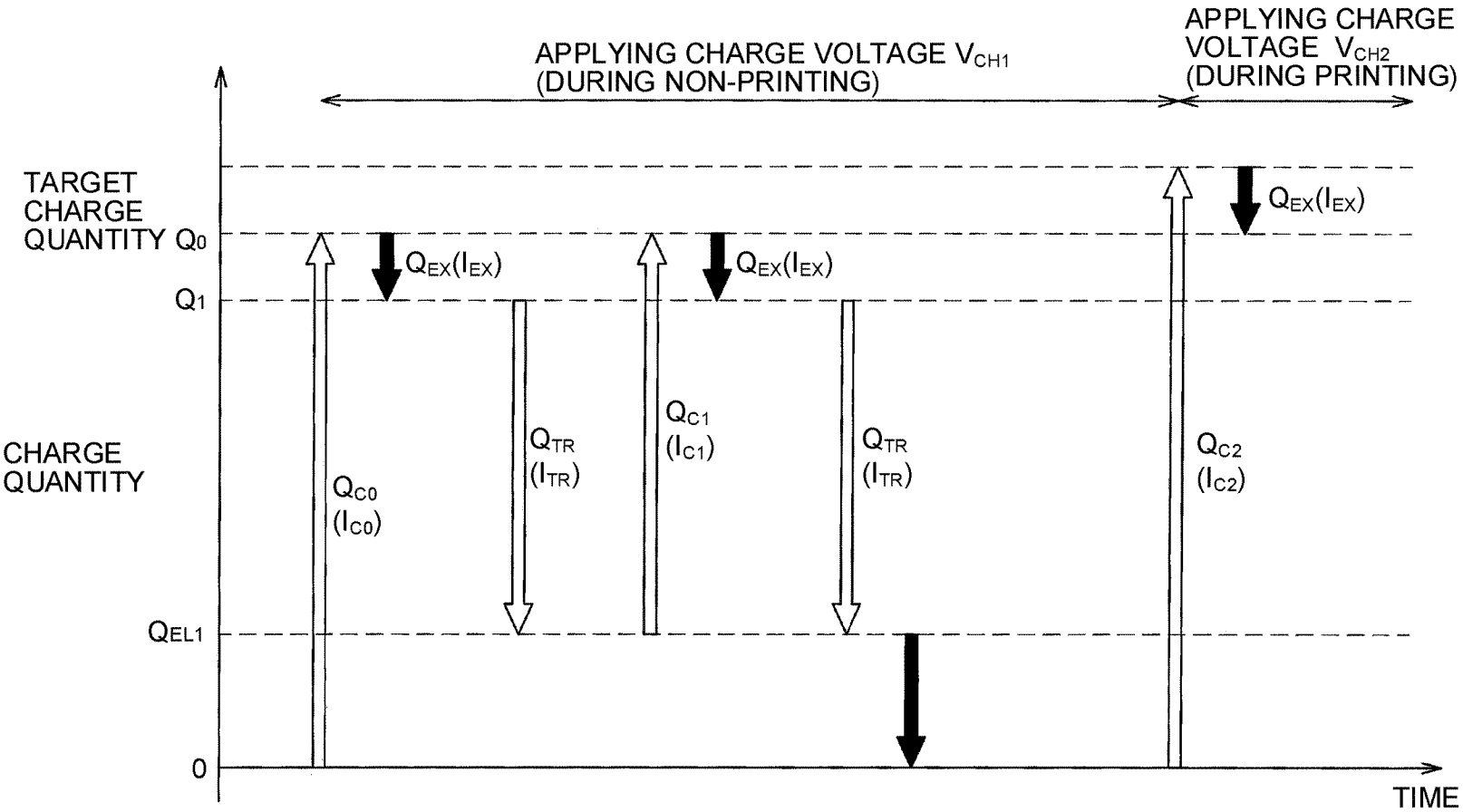
FIG. 3 is a diagram for explaining how to calculate a charge quantity in a circumferential surface of a photosensitive drum in the first illustrative embodiment according to one or more aspects of the disclosure.

The controller 100 is further configured to calculate a current $I_{EX}$ that may change in accordance with the quantity of accumulated charge to be cancelled out by charge generated inside the photosensitive layer by charging. The obtained current $I_{EX}$ may be useful for decreasing influence of the quantity of charge accumulated inside the photosensitive layer of the photosensitive drum 7, thereby enabling accurate stabilization of the surface potential of the photosensitive drum 7. Hereinafter, referring to FIG. 3, an explanation will be provided on how to calculate such a current $I_E$x.

In response to application of a predetermined charge voltage $V_{CH1}$ to the charge roller 8 while some charge has been accumulated inside the photosensitive layer of the photosensitive drum 7 but substantially no charge is present on the circumferential surface of the photosensitive drum 7, the charge roller 8 applies a charge quantity $Q_{C0}$ that is the same as a target charge quantity $Q_0$ to a predetermined portion of the photosensitive drum 7. A current thus passes through the charge roller 8, and the current sensor 31A detects a charge current $I_{C0}$ corresponding to the charge quantity $Q_{C0}$.

Nevertheless, in the photosensitive drum 7, the applied charge quantity $Q_{C0}$ may decrease due to the influence of some of the accumulated charge (e.g., a charge quantity $Q_E$x) inside the photosensitive layer. The reason that the applied charge quantity $Q_{C0}$ may decrease may be considered as follows. In response to the application of the charge quantity $Q_{C0}$ to the circumferential surface of the photosensitive drum 7, an electric field is generated in the photosensitive layer. The generation of the electric field causes some accumulated charge having a polarity opposite to the applied charge to move to an outer surface of the photosensitive layer, thereby causing such an accumulated charge and the charge applied to the photosensitive drum 7 to cancel out each other. The predetermined portion of the photosensitive drum 7 may thus have a surface potential corresponding to a charge quantity $Q_1$ that is smaller than the target charge quantity $Q_0$.

Thereafter, in response to application of a transfer voltage to the transfer roller 9 when the predetermined portion of the photosensitive drum 7 arrives at (e.g., faces) the transfer roller 9, a charge quantity $Q_{TR}$ corresponding to the transfer voltage moves to the transfer roller 9 from the predetermined portion of the photosensitive drum 7. The current sensor 32A thus detects a transfer current $I_{TR}$ corresponding to the charge quantity $Q_{TR}$. Until the predetermined portion of the photosensitive drum 7 arrives at the position where the predetermined portion faces the transfer roller 9 after passing a position where the predetermined portion faces the charge roller 8, exposure by the scanner 10 and developing for supplying toner T by the developing roller 27 are not executed.

After that, when the predetermined portion of the photosensitive drum 7 arrives again at the position where the predetermined portion faces the charge roller 8 without any charge being erased therefrom using the LED lamp 16, a charge voltage $V_{CH1}$ is applied to the charge roller 8. In response, the charge roller 8 applies a charge quantity $Q_{C1}$ to the predetermined portion of the photosensitive drum 7. The charge quantity $Q_{C1}$ may correspond to a difference between a target surface potential and an actual surface potential of the photosensitive drum 7. The current sensor 31A thus detects a charge current $I_{C1}$ corresponding to the charge quantity $Q_{C1}$.

In a case where charge is erased from the predetermined portion of the photosensitive drum 7 using the LED lamp 16, the surface potential of the predetermined portion of the photosensitive drum 7 becomes substantially 0 (zero). Assuming that the charge quantity erased using the LED lamp 16 is $Q_{EL1}$, Equation 1 may be held.

$$Q_{c0}=Q_{EX}+Q_{TR}+Q_{EL1} \quad \text{Equation 1}$$

In a case where charge is not erased from the predetermined portion of the photosensitive drum 7 using the LED lamp 16, the charge quantity $Q_{C1}$ may be expressed by Equation 2.

$$Q_{C1}=Q_{EX}+Q_{TR} \quad \text{Equation 2}$$

In Equation 1, the charge quantity $Q_{C0}$ may be obtained as a current $I_{C0}$ using the current sensor 31A. The charge quantity $Q_{TR}$ may be also obtained as a current $I_{TR}$ using the current sensor 32A. Nevertheless, the charge quantity $Q_{EX}$ and the charge quantity $Q_{EL1}$ might not be obtained using the current sensors 31A and 32A. Thus, using Equation 1 might not accomplish obtainment of the charge quantity $Q_{EX}$ (e.g., the accumulated charge quantity) that may decrease the charge quantity $Q_{C0}$ to be applied to the predetermined portion. Therefore, the current $I_{EX}$ corresponding to the charge quantity $Q_{EX}$ might not be obtained accurately.

In Equation 2, the charge quantity $Q_{C1}$ may be obtained as a current $I_{C1}$ using the current sensor 31A. The charge quantity $Q_{TR}$ may be also obtained as a current $I_{TR}$ using the current sensor 32A. The current $I_{EX}$ corresponding to the charge quantity $Q_{EX}$ may thus be obtained using Equation 3.

$$I_{EX}=I_{C1}-I_{TR} \quad \text{Equation 3}$$

As described above, in a case where charge is erased from the predetermined portion of the photosensitive drum 7 using the LED lamp 16, the surface potential of the predetermined portion of the photosensitive drum 7 becomes substantially 0 (zero). If, therefore, charge is erased from the predetermined portion of the photosensitive drum 7 using the LED lamp 16 between the first charge current detection and the second charge current detection, the charge current detected in the second current detection (e.g., the charge current $I_{C1}$) may be the same current (e.g., $I_{C0}$) as the charge current detected in the first current detection (e.g., the charge current $I_{C0}$). The current $I_{EX}$ thus might not be obtained accurately. Nevertheless, in the illustrative embodiment, after a transfer voltage is applied to the predetermined portion of the photosensitive drum 7, charging may be executed again on the predetermined portion without any charge having been erased therefrom. Such a control may thus enable calculation of the current $I_{EX}$ corresponding to the charge quantity $Q_{EX}$. Therefore, the current $I_{EX}$ may be calculated using Equation 3.

The calculated current $I_{EX}$ is added to the current $I_{C0}$ corresponding to the target charge quantity $Q_0$, thereby enabling calculation of a current $I_{C2}$ and a charge voltage $V_{CH2}$ to be used for printing. In printing, in response to application of the charge voltage $V_{CH2}$ to the predetermined portion of the photosensitive drum 7, the current Ice passes through the photosensitive drum 7. That is, the charge roller 8 applies a charge quantity $Q_{C2}$ corresponding to the current Ice to the photosensitive drum 7. In response, the charge quantity $Q_{C2}$ decreases due to the influence of the charge quantity $Q_{EX}$ and the target charge quantity $Q_0$ thus remains on the circumferential surface of the photosensitive drum 7. Consequently, the surface potential of the photosensitive drum 7 may be stabilized accurately.

The portion of the circumferential surface of the photosensitive drum 7 where no charge remains is suitable for detection of the charge current $I_{C0}$. Such a portion may have a relatively small charge quantity that does not influence on the calculation of the current $I_E$x. For example, that portion may include a portion from which charge has been erased using the LED lamp 16, and a portion which has been self-discharged due to expiration of a long term period from stopping of rotation of the photosensitive drum 7.

That is, the charge current $I_{C0}$ may be a current that is to be applied to the charge roller 8 by the charge voltage application circuit 31. More specifically, in one example, the charge current $I_{C0}$ may be applied to the charge roller 8 for charging the circumferential surface of the photosensitive drum 7 that has not been charged yet after a predetermined time period has elapsed since the photosensitive drum 7 and the charge roller 8 stopped their operations. In another example, the charge current $I_{C0}$ may be applied to the charge roller 8 for charging the circumferential surface of the photosensitive drum 7 from which charge has been erased.

The portion of the circumferential surface of the photosensitive drum 7 which may be suitable for detection of the charge current $I_{C1}$ may be a portion that faces again the charge roller 8 after having undergone first charging but have not undergone any processing that may influence on the charge quantity of the circumferential surface of the photosensitive drum 7 other than transferring. The processing that may influence on the charge quantity of the circumferential surface of the photosensitive drum 7 other than transferring may include, for example, exposure by the scanner, developing for supplying toner T onto the circumferential surface of the photosensitive drum 7 from the developing roller 27, and charge erasure using the LED lamp 16. Transferring that may influence on the charge quantity of the circumferential surface of the photosensitive drum 7 may include application of a transfer voltage to the transfer roller 9, i.e., movement of charge from the circumferential surface of the photosensitive drum 7 to the circumferential surface of the transfer roller 9. In the illustrative embodiment, the controller 100 obtains the charge current $I_{C1}$ during a non-printing period (i.e., while printing is not executed). In the illustrative embodiment, the non-printing period may refer to a period in which although the photosensitive drum 7 is rotating by the motor 17 and electric power is being supplied to the charge roller 8 and the transfer roller 9, the scanner 10 does not execute exposure, the developing roller 27 does not supply toner T onto the circumferential surface of the photosensitive drum 7, nor the LED lamp 16 is not turned on for erasing charge from the photosensitive drum 7. The period in which the developing roller 27 does not supply toner T onto the circumferential surface of the photosensitive drum 7 may include a period in which a developing bias is not being applied to the developing roller 27 and a period in which a developing voltage lower than the charge voltage is being applied.

That is, the charge current $I_{C1}$ may be a current that is to be applied to the charge roller 8 by the charge voltage application circuit 31 while electric power is applied to the transfer roller 9 by the transfer voltage application circuit 32 in the non-printing period. More specifically, for example, the charge current $I_{C1}$ may be applied to the charge roller 8 when charging is executed again on the charged predetermined portion of the circumferential surface of the photosensitive drum 7 that has been charged by the charge roller 8 in response to the charged predetermined portion facing the charge roller 8 by a full turn of rotation of the photosensitive drum 7.

In the illustrative embodiment, the transfer current $I_{TR}$ may be detected at an appropriate timing. In a case where the controller 100 executes a constant current control for controlling the transfer current $I_{TR}$, a detected current and a predetermined current for the constant current control are substantially the same current. The controller 100 may thus obtain the predetermined current prestored in the ROM 20 as the transfer current $I_{TR}$.

In a case where the charge current $I_{C0}$ is obtained while the LED lamp 16 is on, it is preferable that the controller 100 turn the LED lamp 16 on for a first predetermined time period and obtain, as the charge current $I_{C0}$, a current detected between the timing when a charge-erased portion of the circumferential surface of the photosensitive layer arrives at the position where the charge-erased portion faces the charge roller 8 and the timing at which the first predetermined time period elapses. This may thus enable accurate estimation of the charge quantity $Q_{C0}$ to be applied by the charge roller 8 to the portion having no charge remaining on the circumferential surface of the photosensitive drum 7.

The controller 100 further detects the charge current $I_{C1}$ at the portion that has been charged and from which charge has not been erased, in the surface of photosensitive layer. Therefore, in one example, the controller 100 may obtain, as the charge current $I_{C1}$, a current detected in the non-printing period and after the portion charged by the charge roller 8 faces the charge roller 8 again by a full turn of rotation of the photosensitive drum 7. In another example, the controller 100 may obtain, as the charge current $I_{C1}$, a current detected before the charge-erased portion arrives at the position where the charge-erased portion faces the charge roller 8. In still another example, the controller 100 may obtain, as the charge current $I_{C1}$, a current detected in the non-printing period and after the first predetermined time period elapses since the charge-erased portion arrived at the position where the charge-erased portion faces.

Figure 4:
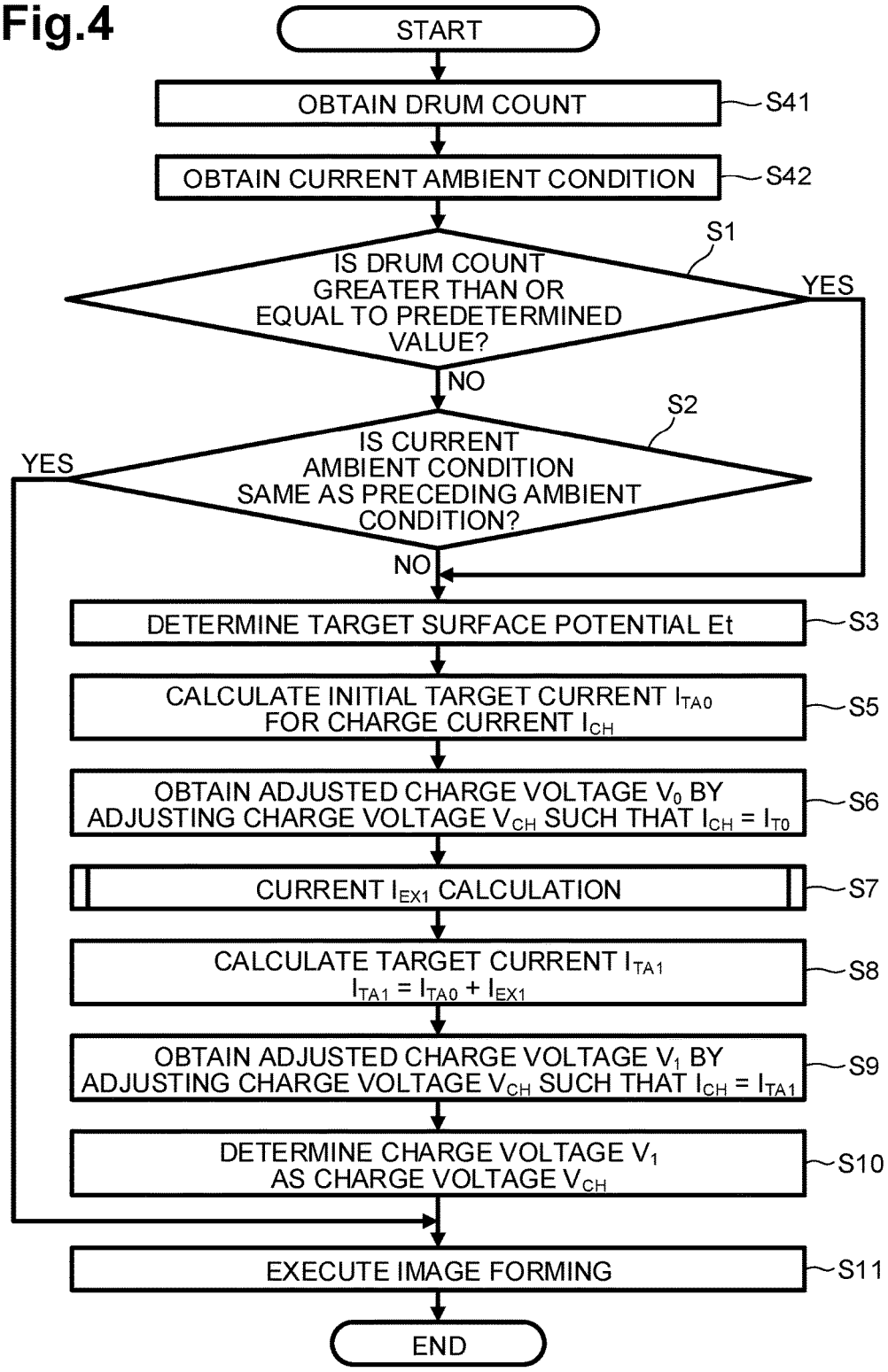
FIG. 4 is a flowchart of processing executed by a controller in the first illustrative embodiment according to one or more aspects of the disclosure.

The controller 100 is further configured to execute initial target current $I_{TA0}$ calculation, charge voltage $V_0$ application, transfer voltage application, charge current $I_{CH}$ acquisition, current $I_{EX1}$ calculation, target current $I_{TA1}$ calculation, first charge voltage $V_{CH}$ adjustment, and charge voltage $V_{CH}$ determination, as well as image forming for forming an image onto a sheet S. Referring to FIG. 4, an explanation will be provided on control executed by the controller 100 and details of the various processing executed by the controller 100.

In response to receipt of a print instruction (e.g., START), the controller 100 executes processing of FIG. 4. In step S41, the controller 100 obtains a drum count that indicates the number of rotations of the photosensitive drum 7. Subsequent to step S41, the controller 100 obtains a current ambient condition by obtaining temperature from a temperature sensor (e.g., step S42). Subsequent to step S42, the controller 100 determines whether the drum count is greater than or equal to a predetermined value (e.g., step S1). More specifically, the controller 100 determines, based on the determination result of the drum count, whether a thickness of the photosensitive layer has changed.

If the controller 100 determines that the drum count is not greater than or equal to the predetermined value (e.g., NO in step S1), the controller 100 determines whether the current ambient condition is the same as the ambient condition occurred at the time of receiving the preceding print instruction (e.g., step S2). More specifically, in step S2, if the controller 100 determines that a difference between the temperature obtained in step S42 in response to receiving the preceding print instruction and the temperature obtained in step S42 in response to receiving the ongoing print instruction is greater than or equal to a predetermined value (e.g., 5° C.), the controller 100 determines that the current ambient condition is different from the preceding ambient condition (e.g., NO in step S2).

If the controller 100 determines that the current ambient condition is different from the preceding ambient condition (e.g., NO in step S2) or if the controller 100 determines that the drum count is greater than or equal to the predetermined value (e.g., YES in step S1), the controller 100 determines, based on the temperature (an example of a second parameter), a target potential for the surface potential of the photosensitive drum 7, i.e., a target surface potential Et (e.g., step S3). The target surface potential Et may be predetermined by experiments or simulations. The target surface potential Et may be specified to be, for example, 700 V. The temperature may be detected by a temperature sensor for detecting ambient temperature around the photosensitive drum 7.

In the illustrative embodiment, in response to the drum count reaching or exceeding the predetermined value (e.g., a threshold), the drum count may be reset to zero. Nevertheless, in other embodiments, for example, in response to the drum count reaching or exceeding the predetermined value, the threshold (e.g., the predetermined value) may be changed to another value.

Subsequent to step S3, the controller 100 calculates an initial target current $I_{TA0}$ for a charge current $I_{CH}$, based on the target surface potential Et and a first parameter that changes in response to the thickness change of the photosensitive layer (e.g., step S5). The first parameter may be, for example, the total number of rotations of the photosensitive drum 7. As the photosensitive layer becomes thinner, static capacitance C increases. Therefore, for obtaining a constant target surface potential Et at the circumferential surface of the photosensitive drum 7, a higher charge current (e.g., a larger charge quantity $Q_0$) needs to be applied to the photosensitive drum 7 as the thickness of the photosensitive layer becomes thinner. It may be considered, for example, that as the total number of rotations of the photosensitive drum 7 increases, the photosensitive layer becomes thinner Thus, as the total number of rotations of the photosensitive drum 7 increases, a greater target value may be specified for the charge current. The relationship between the first parameter and the initial target current $I_{TA0}$ may be predetermined by experiments or simulations.

The processing executed in each of steps S3 and S5 corresponds to the initial target current $I_{TA0}$ calculation. That is, in the initial target current $I_{TA0}$ calculation, the controller 100 calculates the initial target current $I_{TA0}$ for the charge current, based on the target surface potential Et and the first parameter.

Subsequent to step S5, the controller 100 obtains an adjusted charge voltage $V_0$ (e.g., step S6). More specifically, for example, the controller 100 obtains the adjusted charge voltage $V_0$ by adjusting the charge voltage $V_{CH}$ such that the charge current $I_{CH}$ detected by the current sensor 31A becomes equal to the initial target current $I_{TA0}$. The charge voltage $V_0$ may be the charge voltage $V_{CH1}$, and corresponds to an initial charge voltage.

Subsequent to step S6, the controller 100 executes the current $I_{EX1}$ calculation for calculating a current $I_{EX1}$ (e.g., step S7). In step S7, the controller 100 executes the same or similar calculation for obtaining the current $I_{EX}$.

Figure 5:
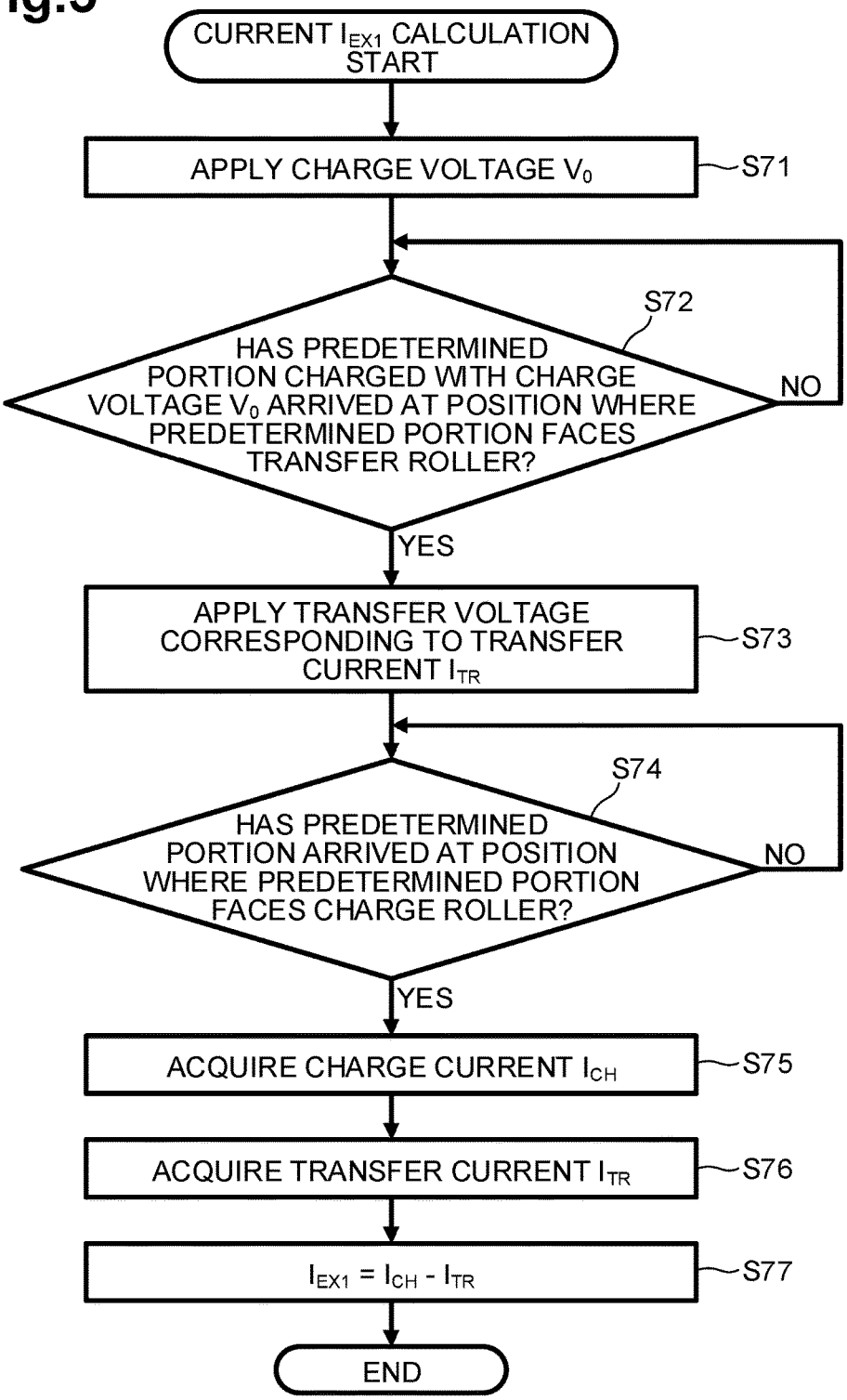
FIG. 5 is a flowchart of current $I_{EX1}$ calculation in the first illustrative embodiment according to one or more aspects of the disclosure.

More specifically, as illustrated in FIG. 5, in the current $I_{EX1}$ calculation, after starting rotation of the photosensitive drum 7, the controller 100 executes the charge voltage application for applying the charge voltage $V_0$ corresponding to the initial target current $I_{TA0}$ to the charge roller 8 (e.g., step S71). The controller 100 continues the charge voltage application until the current $I_{EX1}$ calculation ends.

Subsequent to step S71, the controller 100 determines whether the predetermined portion of the circumferential surface of the photosensitive drum 7 that has been charged in the charge voltage application has arrived at the position where the predetermined portion faces the transfer roller 9 (e.g., step S72). More specifically, for example, in step S72, the controller 100 may determine whether an elapsed time from the start of the application of the charge voltage $V_0$ has reached a predetermined time duration.

If, in step S72, the controller 100 determines that the predetermined portion of the circumferential surface of the photosensitive drum 7 has arrived at the position where the predetermined portion faces the transfer roller 9 (e.g., YES in step S72), the controller 100 executes the transfer voltage application for applying, to the transfer roller 9, a transfer voltage corresponding to the transfer current $I_{TR}$ (e.g., steps S73). Subsequent to step S73, the controller 100 determines whether the predetermined portion whose surface potential has changed in the transfer voltage application has arrived again at the position where the predetermined portion faces the charge roller 8 (e.g., step S74). In step S74, similar to step S72, the controller 100 may determine, based on the elapsed time, whether charged the predetermined portion has arrived again at the position where the predetermined portion faces the charge roller 8.

If, in step S74, the controller 100 determines that the predetermined portion has arrived again at the position where the predetermined portion faces the charge roller 8 (e.g., YES in step S74), the controller 100 executes the charge current acquisition for acquiring a charge current $I_{CH}$ detected based on a detection signal received from the current sensor 31A (e.g., step S75). The charge voltage application started in step S71 is being continued when the charge current acquisition $I_{CH}$ is executed. In step S75, therefore, the charge roller 8 is being applied with the charge voltage $V_0$ corresponding to the initial target current $I_{TA0}$.

Subsequent to step S75, the controller 100 acquires a transfer current $I_{TR}$ detected based on a detection signal received from the current sensor 32A (e.g., step S76). Subsequent to step S76, the controller 100 obtains the current $I_{EX1}$ corresponding to an accumulated charge quantity. More specifically, the controller 100 calculates a difference between the charge current $I_{CH}$ and the transfer current $I_{TR}$ (e.g., step S77). For example, the controller 100 calculates the current $I_{EX1}$ using Equation 3. Requirements for detecting the charge current $I_{CH}$ (e.g., the condition of the surface potential of the photosensitive drum 7) are the same as the requirements for detecting the charge current $I_{C1}$.

Referring to FIG. 4, subsequent to step S7, the controller 100 executes the target current $I_{TA1}$ calculation (e.g., step S8). In the target current $I_{TA1}$ calculation, the controller 100 calculates a target current $I_{TA1}$ by adding the current $I_{EX1}$ to the initial target current $I_{TA0}$ (e.g., step S8). The initial target current $I_{TA0}$ corresponds to the current $I_{C0}$ (refer to FIG. 3). The target current $I_{TA1}$ corresponds to the current $I_{C2}$ (refer to FIG. 3).

Subsequent to step S8, the controller 100 executes the first charge voltage $V_{CH}$ adjustment (e.g., step S9). In the first charge voltage $V_{CH}$ adjustment, the controller 100 obtains an adjusted charge voltage $V_1$ by adjusting the charge voltage $V_{CH}$ such that the charge current $I_{CH}$ detected based on a detection signal received from the current sensor 31A becomes equal to the initial target current $I_{TA1}$. Subsequent to step S9, the controller 100 executes the charge voltage $V_{CH}$ determination (e.g., step S10). In the charge voltage $V_{CH}$ determination, the controller 100 determines the charge voltage $V_1$ obtained by the adjustment in the first charge voltage $V_{CH}$ adjustment as the charge voltage $V_{CH}$ to be applied for forming an image onto a sheet S. The charge voltage $V_1$ corresponds to the charge voltage $V_{CH2}$.

Subsequent to step S10, the controller 100 executes the image forming using the charge voltage $V_1$ determined in step S10 (e.g., step S11) and then ends the processing of FIG. 4. If, in step S2, the controller 100 determines that the current ambient condition is the same as the preceding ambient condition (e.g., YES in step S2), the controller 100 executes the image forming without changing the charge voltage $V_{CH}$ to be applied (e.g., step S11). That is, the controller 100 skips the processing of steps S3 to S10.

The first illustrative embodiment may therefore achieve the following effects.

The current $I_{EX1}$ corresponding to the accumulated charge quantity is obtained based on the detection signal outputted by the current sensor 31A and the current sensor 32A. Therefore, as compared with a known method for predicting an accumulated charge quantity, the control according to the first illustrative embodiment may more reduce an influence of the accumulated charge quantity on the applied charge voltage, thereby enabling accurate stabilization of the surface potential of the photosensitive drum 7.

Second Illustrative Embodiment

A second illustrative embodiment will be described with reference to appropriate accompanying drawings. In the second illustrative embodiment, details of some of the operations and processing to be executed by the controller 100 may be different from those according to the first illustrative embodiment. Therefore, common components or steps have the same reference numerals or step numbers as those of the third illustrative embodiment, and the detailed description of the common components or steps is omitted.

Figure 6:
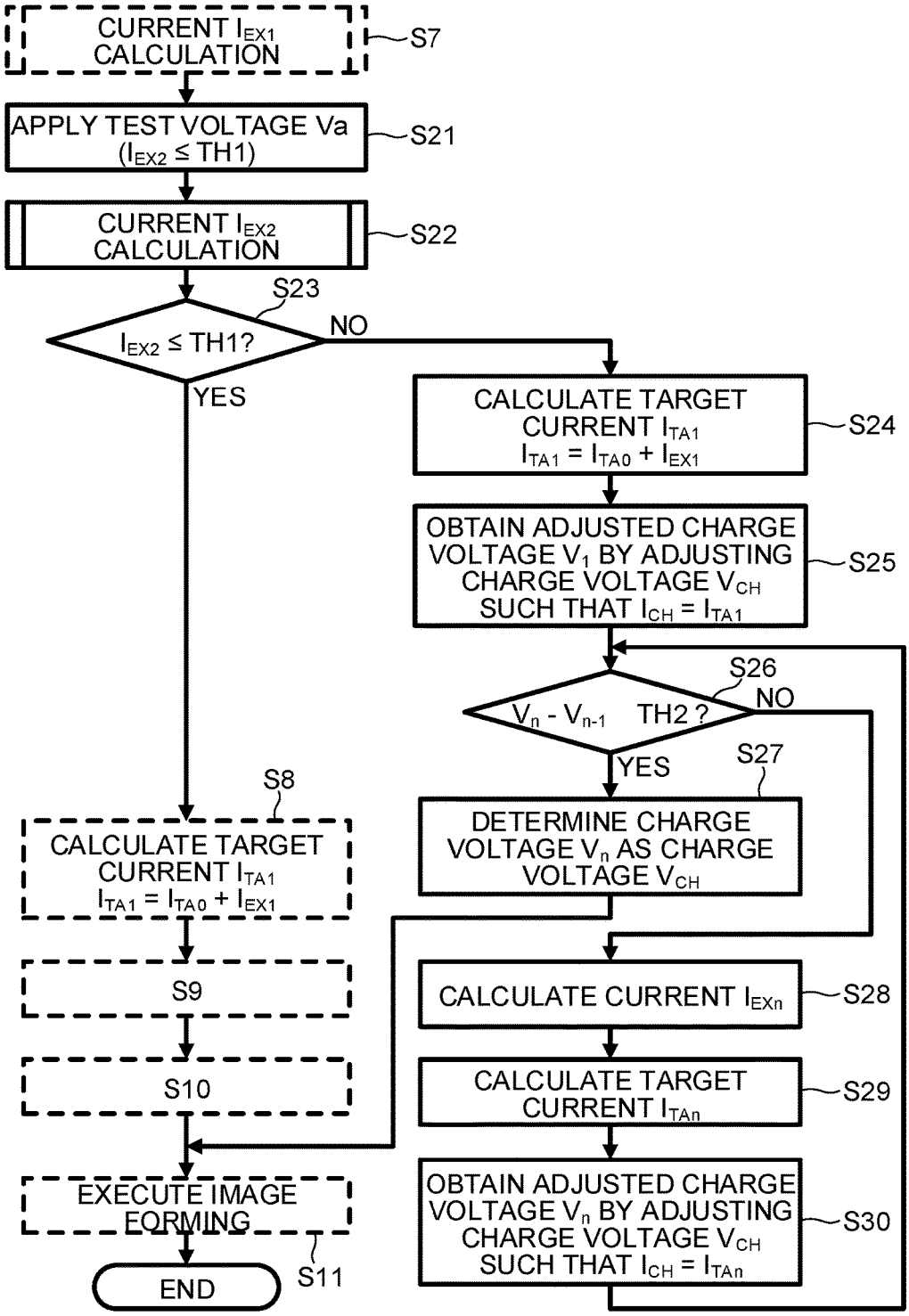
FIG. 6 is a flowchart of processing executed by the controller in a second illustrative embodiment according to one or more aspects of the disclosure.

The controller 100 is further configured to execute test voltage application, charge current $I_{CH}$ acquisition, current $I_{EX2}$ calculation, first determination, second determination, current $I_{EXn}$ calculation, target current correction, target current $I_{TA2}$ calculation, second charge voltage $V_{CH}$ adjustment, as well as the various processing executed according to the first illustrative embodiment. Referring to FIG. 6, an explanation will be provided on details of such various processing executed by the controller 100. The controller 100 is further configured to execute processing of steps S21 to S30 in addition to the processing of steps of S1 to S11 according to the first illustrative embodiment.

As illustrated in FIG. 6, subsequent to step S7, the controller 100 executes the test voltage application (e.g., step S21). In the test voltage application, the controller 100 controls the charge voltage application circuit 31 to apply a test voltage Va to the charge roller 8. The test voltage Va may be higher than the charge voltage $V_0$ corresponding to the initial target current $I_{TA0}$. The test voltage Va is applied to the charge roller 8 for obtaining a current $I_{EX2}$. The test voltage Va is not related to the target current $I_{TAn}$ for the charge current $I_{CH}$. The test voltage Va to be applied is preferably as high as possible. For example, the maximum charge voltage $V_{CH}$ may be specified for the test voltage Va.

Figure 7:
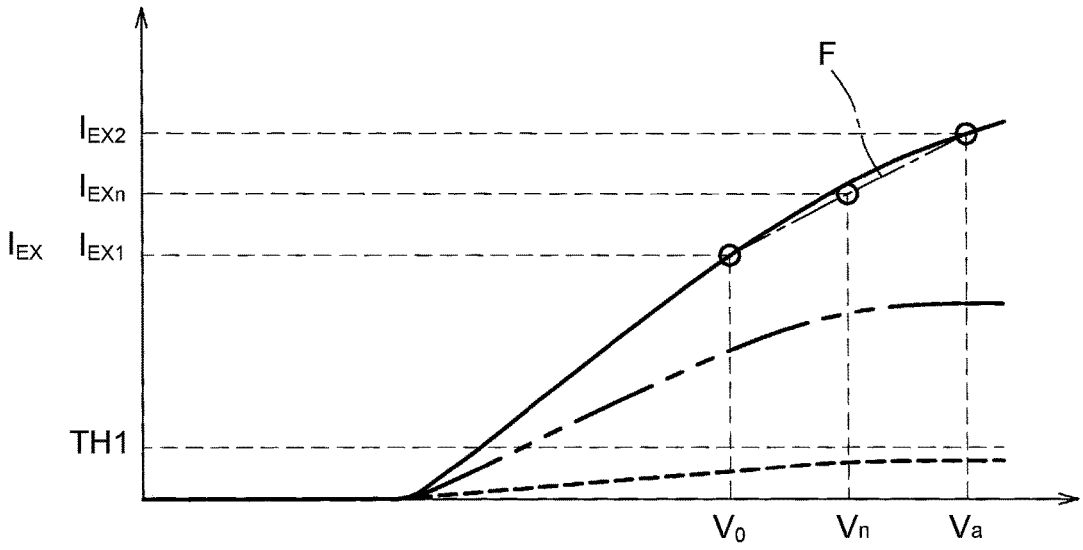
FIG. 7 is a graph showing a relationship between a charge voltage, a current $I_{EX}$, and an accumulated charge quantity in the second illustrative embodiment according to one or more aspects of the disclosure.

As illustrated in FIG. 7, the relationships between the charge voltage V and the current $I_{EX}$ may be significantly different depending on the accumulated charge quantity in the photosensitive layer. In FIG. 7, a dashed line indicates an example relationship between the charge voltage V and the current $I_{EX}$ in a case where the accumulated charge quantity is relatively low. A double-dotted-and-dashed line indicates another example relationship between the charge voltage V and the current $I_{EX}$ in a case where the accumulated charge quantity is larger than that indicated by the dashed line.

As shown in the graph, in the case where the accumulated charge quantity is relatively low (e.g., the case indicated by the dashed line), an amount of change in the current $I_{EX}$ relative to an amount of change in the charge voltage V is relatively small. The greater the accumulated charge quantity, the greater the amount of change in the current $I_{EX}$ relative to the amount of change in the charge voltage V.

As illustrated in FIG. 6, subsequent to step S21, the controller 100 executes the current $I_{EX2}$ calculation for calculating a current $I_{EX2}$ (e.g., step S22). The current $I_{EX2}$ calculation may be the same or similar to the current $I_{EX1}$ calculation. More specifically, for example, in the current $I_{EX2}$ calculation, the controller 100 executes the same or similar processing to the processing of each of steps S72 to S77. In the current $I_{EX2}$ calculation, the controller 100 executes the transfer voltage application when the predetermined portion of the circumferential surface of the photosensitive drum 7 that has been charged in the test voltage application passes the position where the predetermined portion faces the transfer roller 9 (e.g., steps S72 and S73).

Subsequent to step S73, the controller 100 executes the charge current $I_{CH}$ acquisition (e.g., steps S74 and S75). In the charge current $I_{CH}$ acquisition, when the predetermined portion whose surface potential has changed by the transfer voltage application passes again the position where the predetermined portion faces the charge roller 8, the controller 100 acquires a charge current $I_{CH}$ detected based on a detection signal received from the current sensor 31A while the charge voltage application circuit 31 applies the test voltage Va to the charge roller 8.

Subsequent to step S75, the controller 100 obtains the current $I_{EX2}$. More specifically, for example, the controller 100 calculates a difference between the charge current $I_{CH}$ and the transfer current $I_{TR}$ that passes through the transfer roller 9 during the transfer voltage application (e.g., step S77). That is, in step S22, the controller 100 obtains the current $I_{EX2}$ by calculating a difference between the charge current $I_{CH}$ detected based on a detection signal received from the current sensor 31A and the transfer current $I_{TR}$ detected based on a detection signal received from the current sensor 32A while the test voltage Va is applied to the charge roller 8. Requirements for detecting the charge current $I_{CH}$ (e.g., the condition of the surface potential of the photosensitive drum 7) are the same as the requirements for detecting the charge current $I_{C1}$.

Subsequent to step S22, the controller 100 executes the first determination (e.g., step S23). In the first determination, the controller 100 determines whether the current $I_{EX2}$ is lower than or equal to a threshold TH1. Such first determination may accomplish determination as to whether the accumulated charge quantity in the photosensitive layer is relatively small, as illustrated in FIG. 7. The threshold TH1 may be predetermined by experiments or simulations. In one example, the threshold TH1 may be 5 μA.

As illustrated in FIG. 6, if the controller 100 determines, in the first determination, that $I_{EX2} \leq TH1$ (e.g., YES in step S23), the controller 100 executes the processing of each of steps S8 to S10. Subsequent to step S10, the controller 100 executes the image forming (e.g., step S11) and ends this control. Where $I_{EX2} \leq TH1$, it is conceivable that the accumulated charge quantity in the photosensitive layer may be relatively low. Thus, in step S9, when the controller 100 adjusts the charge current $V_{CH}$, the amount of change in the current $I_{EX}$ is sufficiently small. That is, the current $I_{EX}$ has only little influence on the applied charge voltage. Thus, the controller 100 may execute the image forming properly with application of the voltage $V_1$ corresponding to the target current $I_{TA1}$.

If, in step S23, the controller 100 determines that $I_{EX2} > TH1$ (e.g., NO in step S23), it is conceivable that the accumulated charge quantity in the photosensitive layer may be relatively high. Thus, the controller 100 executes the following steps to obtain a target current $I_{TAn}$ with consideration given to the influence of the current $I_{EX}$ on the applied charge voltage. More specifically, for example, the controller 100 executes the target current $I_{TA1}$ calculation (e.g., step S24) and the first charge voltage $V_{CH}$ adjustment (e.g., step S25), which are the same or similar to steps S8 and S9, respectively.

Subsequent to step S25, the controller 100 executes the second determination (e.g., step S26). In the second determination, the controller 100 determines whether a difference ($V_n - V_{n-1}$) between the present voltage $V_n$ and the last voltage $V_{n-1}$ is smaller than or equal to a threshold TH2 (e.g., step S26). If the controller 100 determines, in the second determination, that $V_n - V_{n-1} \leq TH2$ (e.g., YES in step S26), the controller 100 determines the present voltage $V_n$ as the charge voltage $V_{CH}$ (e.g., step S27), and then executes the image forming (e.g., step S11).

More specifically, for example, in a case where this is the first time that the controller 100 has executed the second determination since receiving the ongoing print instruction, the controller 100 determines, in the second determination, whether a difference between the charge voltage $V_1$ obtained by the adjustment in the first charge voltage $V_{CH}$ adjustment and the charge voltage $V_0$ corresponding to the initial charge voltage is smaller than or equal to the threshold TH2. If the controller 100 determines, in the second determination, that $V_n - V_{n-1} \leq TH2$ (e.g., YES in step S26), the controller 100 determines the charge voltage $V_1$ as the charge voltage $V_{CH}$ (e.g., step S27), and then executes the image forming (e.g., step S11). Determining the charge voltage $V_1$ as the charge voltage $V_{CH}$ in step S27 corresponds to the charge voltage $V_{CH}$ determination.

If the controller 100 determines that $V_n - V_{n-1} \leq TH2$, i.e., if the controller 100 determines that the difference between the present voltage $V_n$ and the last voltage $V_{n-1}$ is relatively small, the amount of change in the current $I_{EX}$ is sufficiently small (refer to FIG. 7). That is, a difference between the current $I_{EX}$ passing in response to application of the charge voltage $V_{CH}$ corresponding to the last voltage $V_{n-1}$ to the charge roller 8 and the current $I_{EX}$ passing in response to application of the charge voltage $V_{CH}$ corresponding to the present voltage $V_n$ to the charge roller 8 is relatively small. The current $I_{EX}$ may thus have only little influence on the applied charge voltage, thereby enabling the image forming properly using the present voltage $V_n$. The threshold TH2 may be predetermined by experiments or simulations. In one example, the threshold TH2 may be 5 V.

If the controller 100 determines, in the second determination, that $V_n - V_{n-1} > TH2$ (e.g., NO in step S26), the controller 100 executes the current $I_{EXn}$ calculation (e.g., step S28). In the current $I_{EXn}$ calculation, the controller 100 calculates a current $I_{EXn}$ using the charge voltage $V_{CH}$ corresponding to the present value $V_n$ and a predetermined function. More specifically, in a case where this is the first time that the controller 100 has executed the second determination (e.g., step S26) since receiving the ongoing print instruction, the controller 100 calculates the current $I_{EXn}$ using the charge voltage $V_1$ obtained by the adjustment in the first charge voltage $V_{CH}$ adjustment and the predetermined function. More specifically, for example, the predetermined function may be a linear approximation formula F, which may be obtained by the charge voltage $V_0$, the test voltage Va, the current $I_{EX1}$, and the current $I_{EX2}$ (refer to FIG. 7). The controller 100 calculates the current $I_{EXn}$ by substituting the present voltage $V_n$ for the linear approximation formula F.

Subsequent to step S28, the controller 100 calculates another target current $I_{TAn}$ by adding the current $I_{EXn}$ to the initial target current $I_{TA0}$ (e.g., step S29). The processing of steps S28 and S29 corresponds to the target current correction. In a case where this is the first time that the controller 100 has executed the target current correction since receiving the ongoing print instruction, the controller 100 calculates, based on the initial target current $I_{TA0}$ and the current $I_{EXn}$, a target current $I_{TA2}$ for the charge current. Calculating such a target current $I_{TA2}$ corresponds to the target current $I_{TA2}$ calculation.

Subsequent to step S29, i.e., subsequent to the execution of the target current correction, the controller 100 obtains an adjusted voltage $V_{n+1}$ by adjusting the charge voltage $V_{CH}$ such that the charge current $I_{CH}$ detected based on a detection signal received from the current sensor 31A becomes equal to the initial target current $I_{TAn}$ (e.g., step S30). In a case where this is the first time that the controller 100 has executed the processing of step S30 since receiving the ongoing print instruction, in step S30, the controller 100 obtains an adjusted voltage $V_2$ by adjusting the charge voltage $V_{CH}$ such that the charge current $I_{CH}$ detected based on a detection signal received from the current sensor 31A becomes equal to the initial target current $I_{TA2}$. Adjusting the charge voltage $V_{CH}$ as such corresponds to the second charge voltage $V_{CH}$ adjustment.

Subsequent to step S30, the controller 100 returns to step S26 to execute the second determination again. When the controller 100 executes the second determination for the second time (or subsequent times), the controller 100 uses the voltage $V_{n+1}$ obtained at step S30 as the present value $V_n$. In the second determination for the second time, the controller 100 determines whether a different between the charge voltage $V_2$ obtained by the adjustment in the second charge voltage $V_{CH}$ adjustment and the charge voltage $V_1$ obtained by the adjustment in the first charge voltage $V_{CH}$ adjustment is smaller than or equal to the threshold TH2. If the controller 100 determines that $V_2 - V_1 \leq TH2$ (e.g., YES in step S26), the controller 100 determines the charge voltage $V_2$ obtained by the adjustment in the second charge voltage $V_{CH}$ adjustment as the charge voltage $V_{CH}$ used for the image forming.

The second illustrative embodiment may therefore achieve the following effects.

In a case where the current $I_{EX2}$ passing in response to the application of the test voltage Va higher than the charge voltage $V_0$ to the charge roller 8 is lower than or equal to the threshold TH1, the current $I_{EX}$ may have only little influence on the applied charge voltage, thereby enabling the image forming appropriately using the voltage $V_1$ corresponding to the target current $I_{TA1}$.

In a case where $V_1-V_0 \leq TH2$ although the current $I_{EX2}$ passing in response to the application of the test voltage Va higher than the charge voltage $V_0$ to the charge roller 8 is not lower than or equal to the threshold TH1, the current $I_{EX}$ may have only little influence on the applied charge voltage, thereby enabling the image forming appropriately using the voltage $V_1$ corresponding to the target current $I_{TA1}$.

In a case where $V_n-V_{n-1} > TH2$, the controller 100 executes the target current correction until $V_n-V_{n-1} \leq TH2$ is held. Such a control may thus reduce the influence of the current EX on the applied charge voltage.

The predetermined function may be the linear approximation formula F, which may be obtained by the charge voltage $V_0$, the test voltage Va, the current $I_{EX1}$, and the current $I_{EX2}$. Using such a linear approximation formula F may thus implement the target current correction properly.

While the disclosure has been described in detail with reference to the specific embodiments thereof, these are merely examples, and various changes, arrangements and modifications may be applied therein without departing from the spirit and scope of the disclosure.

In the illustrative embodiments, the first parameter that changes in accordance with the change of the thickness of the photosensitive layer may be the total number of rotations of the photosensitive drum 7. Nevertheless, in other embodiments, for example, the first parameter may be the total number of printed sheets or the total number of dots in printed image data. The second parameter is not limited to the temperature. In other embodiments, for example, the second parameter may be any parameter related to ambient condition. For example, the second parameter may be humidity or a combination of temperature and humidity. For example, in a case where the second parameter is humidity, in step S2, if the controller 100 determines that a difference between the humidity obtained in step S42 in response to receiving the preceding print instruction and the humidity obtained in step S42 in response to receiving the ongoing print instruction is greater than a predetermined threshold (e.g., 20%), the controller 100 determines that the current ambient condition is different from the preceding ambient condition (e.g., NO in step S2).

In the illustrative embodiments, on condition that the controller 100 determines that a new print instruction has been received and the drum count is greater than or equal to the predetermined value, the controller 100 calculates the target current $I_{TA1}$ for the charge current $I_{CH}$. Nevertheless, in other embodiments, for example, on condition that the controller 100 determines that power of the image forming apparatus is turned on and the drum count is greater than or equal to the predetermined value, the controller 100 may calculate the target current $I_{TA1}$ for the charge current $I_{CH}$.

In the second illustrative embodiment, the controller 100 determines, in the first determination, whether the current $I_{EX2}$ is lower than or equal to the threshold TH1. Nevertheless, in other embodiments, for example, the controller 100 may determine, in the first determination, whether a difference between the current $I_{EX2}$ and the current $I_{EX1}$ is lower than or equal to a threshold TH3. In such a case, also, the controller 100 may determine whether $I_{EX2} \leq TH3+I_{EX1}$ is held, which means that the controller 100 determines whether the current $I_{EX2}$ is lower than or equal to the threshold TH1 (e.g., $TH3+I_{EX1}$).

The image forming apparatus is not limited to the monochrome laser printer 1, but in other embodiments, for example, may be a color printer, a copying machine, and a multifunction device.

The charger is not limited to the charge roller 8, but in other embodiments, for example, may be a scorotron charger.

The photosensitive member is not limited to the photosensitive drum 7, but in other embodiments, for example, may be a belt-shaped member.

The transfer medium is not limited to the sheet S, but in other embodiments, for example, may be an envelope or a film. For an intermediate transfer laser printer, the transfer member may be, for example, an intermediate transfer belt.

The transfer member is not limited to the transfer roller 9, but in other embodiments, for example, may be another member to which the transfer voltage may be applied, such as a conductive brush or a conductive leaf spring.

The one or more aspects of the disclosure may be implemented in various combinations of the elements described in the illustrative embodiments and variations.

What is claimed is:

1. An image forming apparatus comprising:

a photosensitive member having a photosensitive layer, the photosensitive layer including a circumferential surface;

a charger configured to charge the circumferential surface;

a transfer member configured to transfer a developer image onto a recording medium from the circumferential surface of the photosensitive member; and a controller comprising a processor and memory with instructions, the controller configured to while developer is not supplied to at least a portion of the circumferential surface, as at least the portion of the circumferential surface faces the charger and an initial charge voltage is supplied to the charger, monitor a first current relating to a first application of the initial charge voltage to at least the portion of the circumferential surface;

as at least the portion of the circumferential surface faces the transfer member, supply a transfer voltage to the transfer member; and as at least the portion of the circumferential surface again faces the charger and the initial charge voltage is supplied to the charger, monitor a second current relating to a second application of the initial charge voltage to at least the portion of the circumferential surface; and while developer is supplied to at least the portion of the circumferential surface, supply a first charge voltage to the charger, and wherein the first charge voltage is determined based on the first current, a transfer current related to supplying the transfer voltage, and the second current.

2. The image forming apparatus according to claim 1, wherein the controller is configured to determine the first charge voltage based on the monitoring of the first current and the monitoring the second current while developer is not supplied to the circumferential surface.

3. The image forming apparatus according to claim 1, further comprising:

a sensor, wherein the transfer current related to the supplying of the transfer voltage is obtained by the sensor.

4. The image forming apparatus according to claim 1, wherein the determination of the first charge voltage uses a predetermined value for the transfer current.

5. The image forming apparatus according to claim 1, wherein a printing period includes supplying developer to at least the portion of the circumferential surface, and wherein a non-printing period includes supplying the charger with the initial charge voltage while no developer is supplied to at least the portion of the circumferential surface.

6. The image forming apparatus according to claim 1, wherein the first current is $I_{C0}$, wherein the second current is $I_{C1}$, wherein the transfer current is $I_{TR}$, and wherein the first charge voltage is proportional to the following value:

$I_{C0}+I_{C1}-I_{TR}$.

7. The image forming apparatus according to claim 6, wherein the controller is further configured to perform the determination of the first charge voltage during a non-printing period, and wherein the non-printing period includes supplying the charger with the initial charge voltage while no developer is supplied to at least the portion of the circumferential surface.

8. The image forming apparatus according to claim 1, wherein the controller is further configured to obtain a drum count, wherein the supplying of the first charge voltage includes, when the drum count is greater than or equal to a threshold, supplying the first charge voltage to at least the portion during a printing operation, and wherein the supplying of the first charge voltage includes, when the drum count is less than the threshold, supplying a previously supplied charge voltage to at least the portion during a printing operation.

9. The image forming apparatus according to claim 8, wherein the previously supplied charge voltage is the same as the initial charge voltage.

10. The image forming apparatus according to claim 8, wherein the previously supplied charge voltage is different from the initial charge voltage.

11. The image forming apparatus according to claim 1, wherein the controller is further configured to perform test charging in a non-printing period, the test charging including applying, to the charger, a test charge voltage higher than the initial charge voltage;

as at least the portion, which has been charged in the test charging, of the circumferential surface of the photosensitive member faces the transfer member, supply the transfer voltage to the transfer member, and as at least the portion of the circumferential surface again faces the charger and the test charge voltage is supplied to the charger, monitor a current relating to a second application of the test charge voltage to at least the portion of the circumferential surface; and determining a difference between the current relating to the second application of the test charge voltage to at least the portion of the circumferential surface and the transfer current related to supplying the transfer voltage.

12. The image forming apparatus according to claim 11, wherein, when the difference is less than or equal to a first threshold, the first charge voltage is applied to the charger in a printing period, and wherein, when the difference is greater than the first threshold, a voltage equal to or greater than the first charge voltage is applied to the charger in the printing period.

13. The image forming apparatus according to claim 12, wherein, the difference is a first difference, wherein, when the first difference is greater than the first threshold and a second difference between the first charge voltage and the initial charge voltage is less than or equal to a second threshold, a voltage equal to the first charge voltage is applied to the charger in the printing period, and wherein, when the first difference is greater than the first threshold and the second difference is greater than the second threshold, a voltage greater than the first charge voltage is applied to the charger in the printing period.

14. The image forming apparatus according to claim 1, wherein the charger includes a charging roller.

15. The image forming apparatus according to claim 1, wherein the transfer member includes a transfer roller.

16. The image forming apparatus according to claim 1, further comprising a charge eraser configured to erase charge on the circumferential surface of the photosensitive member, wherein the controller is further configured to control the charge eraser to erase the charge on the circumferential surface of the photosensitive member before the first application of the initial charge voltage to the charger, and prevent the charge eraser from erasing at least the portion of the circumferential surface until the charger received the second application of the initial charge voltage.

17. A non-transitory computer-readable storage medium storing computer-readable instructions, the computer-readable instructions executable by a processor of an image forming apparatus configured to perform a printing process in which an image is formed using developer on a recording medium, wherein the computer-readable instructions, when executed by the processor, cause the image forming apparatus to perform:

while developer is not supplied to at least a portion of a circumferential surface of a photosensitive layer of a photosensitive member, as at least the portion of the circumferential surface faces a charger and an initial charge voltage is supplied to the charger, monitoring a first current relating to a first application of the initial charge voltage to at least the portion of the circumferential surface;

as at least the portion of the circumferential surface faces a transfer member, supplying a transfer voltage to a transfer member;

as at least the portion of the circumferential surface again faces the charger and the initial charge voltage is supplied to the charger, monitoring a second current relating to a second application of the initial charge voltage to at least the portion of the circumferential surface; and determining a first charge voltage based on the first current, a transfer current related to supplying the transfer voltage, and the second current; and while developer is supplied to at least the portion of the circumferential surface, supplying the first charge voltage to the charger.

18. A control method to be executed by a controller of an image forming apparatus, the image forming apparatus configured to perform a printing process in which a developer image is formed on the recording medium, the control method comprising:

while developer is not supplied to at least a portion of a circumferential surface of a photosensitive layer of a photosensitive member, as at least the portion of the circumferential surface faces a charger and an initial charge voltage is supplied to the charger, monitoring a first current relating to a first application of the initial charge voltage to at least the portion of the circumferential surface;

as at least the portion of the circumferential surface faces a transfer member, supplying a transfer voltage to a transfer member;

as at least the portion of the circumferential surface again faces the charger and the initial charge voltage is supplied to the charger, monitoring a second current relating to a second application of the initial charge voltage to at least the portion of the circumferential surface; and determining a first charge voltage based on the first current, a transfer current related to supplying the transfer voltage, and the second current; and while developer is supplied to at least the portion of the circumferential surface, supplying the first charge voltage to the charger.

* * * * *